United States Patent [19]

Porter

[11] Patent Number: 4,671,038

[45] Date of Patent: Jun. 9, 1987

[54] ROOF SANDWICH PANEL JUNCTURE RUNNING WITH THE PITCH

[76] Inventor: William H. Porter, P.O. Box 249, Saugatuck, Mich. 49453

[21] Appl. No.: 857,366

[22] Filed: Apr. 30, 1986

[51] Int. Cl.[4] ..... E04C 1/10

[52] U.S. Cl. ..... 52/586; 52/468; 52/584; 52/404; 52/465

[58] Field of Search ..... 52/461, 586, 462, 463, 52/464, 465, 466, 467, 468, 469, 470, 584, 404

[56] References Cited

U.S. PATENT DOCUMENTS

| | | | |
|---|---|---|---|
| 938,768 | 11/1909 | Kenny . | |
| 2,339,865 | 1/1944 | Larmour | 52/468 X |
| 2,730,772 | 1/1956 | Jones . | |
| 2,803,858 | 11/1957 | Rader . | |
| 2,907,287 | 10/1959 | Trostle | 52/463 |
| 2,916,261 | 12/1959 | Parkinson et al. . | |
| 3,111,787 | 11/1963 | Chamberlain . | |
| 3,228,822 | 1/1966 | Norman . | |
| 3,415,028 | 12/1968 | Nerem . | |
| 3,818,659 | 6/1974 | Anderson . | |
| 3,835,606 | 9/1974 | Liberman . | |
| 3,886,676 | 6/1975 | Alfonso . | |
| 3,975,880 | 8/1976 | Fischer, Jr. | 52/469 X |
| 4,009,548 | 3/1977 | Hicks . | |
| 4,020,611 | 5/1977 | Amos | 52/584 |
| 4,135,342 | 1/1979 | Cotter | 52/404 X |
| 4,139,974 | 2/1979 | Fox . | |
| 4,155,206 | 5/1979 | Player | 52/404 X |
| 4,244,151 | 1/1981 | Seem | 52/404 X |
| 4,246,735 | 1/1981 | Herzfeld | 52/465 |
| 4,307,553 | 12/1981 | Puckett | 52/470 |
| 4,366,656 | 1/1983 | Simpson . | |
| 4,443,988 | 4/1984 | Coutu, Sr. . | |
| 4,599,842 | 7/1986 | Counihan | 52/586 |

*Primary Examiner*—William F. Pate, III
*Assistant Examiner*—Creighton Smith
*Attorney, Agent, or Firm*—Emrich & Dithmar

[57] ABSTRACT

A roof panel juncture securely couples in a water sealed, abutting manner facing edges of adjacent, generally planar roof panels along the pitch of the roof. Each panel includes an upper sheet metal facing, a lower vinyl covered wood facing, and a core of rigid foam insulation sandwiched therebetween. The lateral edges of the panel's upper sheet metal facing are each provided with a 90° upturned portion, the upper end portion of which is further bent downward at an acute angle toward the plane of the sheet metal facing to form a hook and drip-edge. The adjacent upturned facing edge portions of abutting panels are adapted to receive in sliding engagement along the lengths thereof a generally concave, elongated, linear roof batten which maintains adjacent roof panel edges in tight-fitting engagement so as to form a water-tight seal therebetween. The adjacent lateral edges of the lower facings of each of the roof panels are adapted to receive a ceiling batten therebetween along the length of the panels. The ceiling batten includes a lower slot along the length thereof which, in combination with a snap-in strip plate, forms an enclosed raceway for wire runs. A blocking spline is inserted in facing edges of adjacent panels and is maintained in position by the ceiling batten and provides a heat conduction break in the roof and reinforces the roof panel juncture.

33 Claims, 3 Drawing Figures

ROOF SANDWICH PANEL JUNCTURE RUNNING WITH THE PITCH

BACKGROUND OF THE INVENTION

This invention relates generally to pitched panel roofs and is particularly directed to a roof panel juncture for multi-layered roof panels which is aligned with the pitch of the roof.

Where a roof is comprised of several, generally flat panels, adjoining panels must be lapped or coupled in such a manner as to provide a sturdy structure which is weatherproof and easily installed. In the past, attempts to securely couple adjacent roof panels have met with considerable difficulty, frequently requiring the cutting and fitting of individual roof panels on the job site or the use of complicated and expensive connecting arrangements and tools. In spite of these efforts to provide a sturdy, sealed panel roof, prior art roof structures comprised of a plurality of coupled roof panels generally suffer from leaking due primarily to the capillary action between abutting edge portions of the panels and the freezing and thawing cycle of the air, water and water vapor trapped between the various surfaces, or layers, within the panel roof.

The assembly of prior art panel roofs typically required not only the incorporation of each of the individual panels in the roof structure, but also the application of a weather coating seal along the joint lines between adjacent roof panels, the application of an insulating layer to the underside of the roof panels, and the positioning of a ceiling structure beneath the insulating layer for the support thereof and to provide an attractive interior appearance. Each of the aforementioned structures is generally incorporated in the roof system in a sequential, step-wise manner, proceeding from the outside to the inside. This procedure is tedious as well as labor-intensive, and thus expensive, and still does not guarantee a roof system which completely isolates the area beneath the roof from the elements above the roof. The aforementioned procedure is further complicated where additional elements, such as electrical wiring, fixtures, etc., must be accommodated.

The present invention overcomes the aforementioned limitations of the prior art by providing a prefabricated, inexpensively produced, and easily installed roof sandwich panel having a panel juncture running with the pitch of the roof which is comprised of a minimum number of components, can be easily secured in a tight fitting manner, and provides a reliable and long lasting seal between adjacent panels which is impervious to water and other environmental elements. By uniquely configuring abutting upper edges of adjacent panels and inserting in a sliding manner along the length of the panel edges a roof batten, an inter-panel watertight seal is provided. By coupling the lower facing edge portions of the insulated roof panel by means of a ceiling batten extending along the lengths of the panels, adjacent panels are also securely coupled along the lower edge portions thereof. The lower ceiling batten forms a raceway for electrical conductors and provides a finished appearance for the ceiling and support for a blocking spline positioned in the inter-panel joint which increases panel juncture strength and provides a thermal barrier for the juncture.

OBJECTS AND SUMMARY OF THE INVENTION

Accordingly, it is an object of the present invention to provide an improved juncture or joint for multi-layer roof panels.

It is another object of the present invention to provide a water sealed coupling between adjacent roof sandwich panels which is aligned with the pitch of the roof.

Yet another object of the present invention is to provide a sealed joint arrangement for adjacent roof panels which is waterproof, provides an effective thermal barrier, and affords an attractive joint covering for a ceiling formed of the roof panels.

Still another object of the present invention is to provide a dual batten arrangement in the form of a pair of elongated metal extrusions for use with adjacent roof/ceiling panels which provides a water sealed, thermally insulated joint between the panels and forms a raceway for supporting electrical conductors in an enclosed manner.

A further object of the present invention is to provide a pitched roof system which includes a finished ceiling, an electrical raceway, insulated panel joints which are structurally reinforced, and a weather resistant seal between adjacent roof panels.

The present invention contemplates a roof sandwich panel juncture running with the pitch of the roof for use with panels having a sheet metal upper facing, a wood lower facing, and a rigid foam core of insulating material therebetween. Lateral edges of the sheet metal upper facing are upturned at 90° and are further bent downward at an acute angle toward the plane of the sheet metal facing to form a hook and drip-edge. An upper roof batten in the form of an elongated, linear metal extrusion is adapted to securely engage facing upturned edge portions of adjacent panels in a sliding manner along the length thereof and to form a water sealed coupling therebetween. A plurality of deformable mastic strips are positioned in spaced relation between adjacent, facing panel edges as well as between the upper roof batten and the two adjacent sheet metal upper facings of the panels to provide sealed engagement therebetween. Each lower facing edge portion of adjacent panels is provided with a respective slot for receiving a blocking spline therein which serves to strengthen the inter-panel juncture and forms a thermal barrier.

A second lower ceiling batten, also in the form of an elongated linear metal extrusion, engages the lower facing edge portions of adjacent panels and provides secure coupling therebetween as well as support for the blocking spline. The ceiling batten, in combination with a snap-in plate, forms an enclosed raceway for receiving electrical conductors and conceals the inter-panel juncture to provide a finished appearance for the ceiling.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
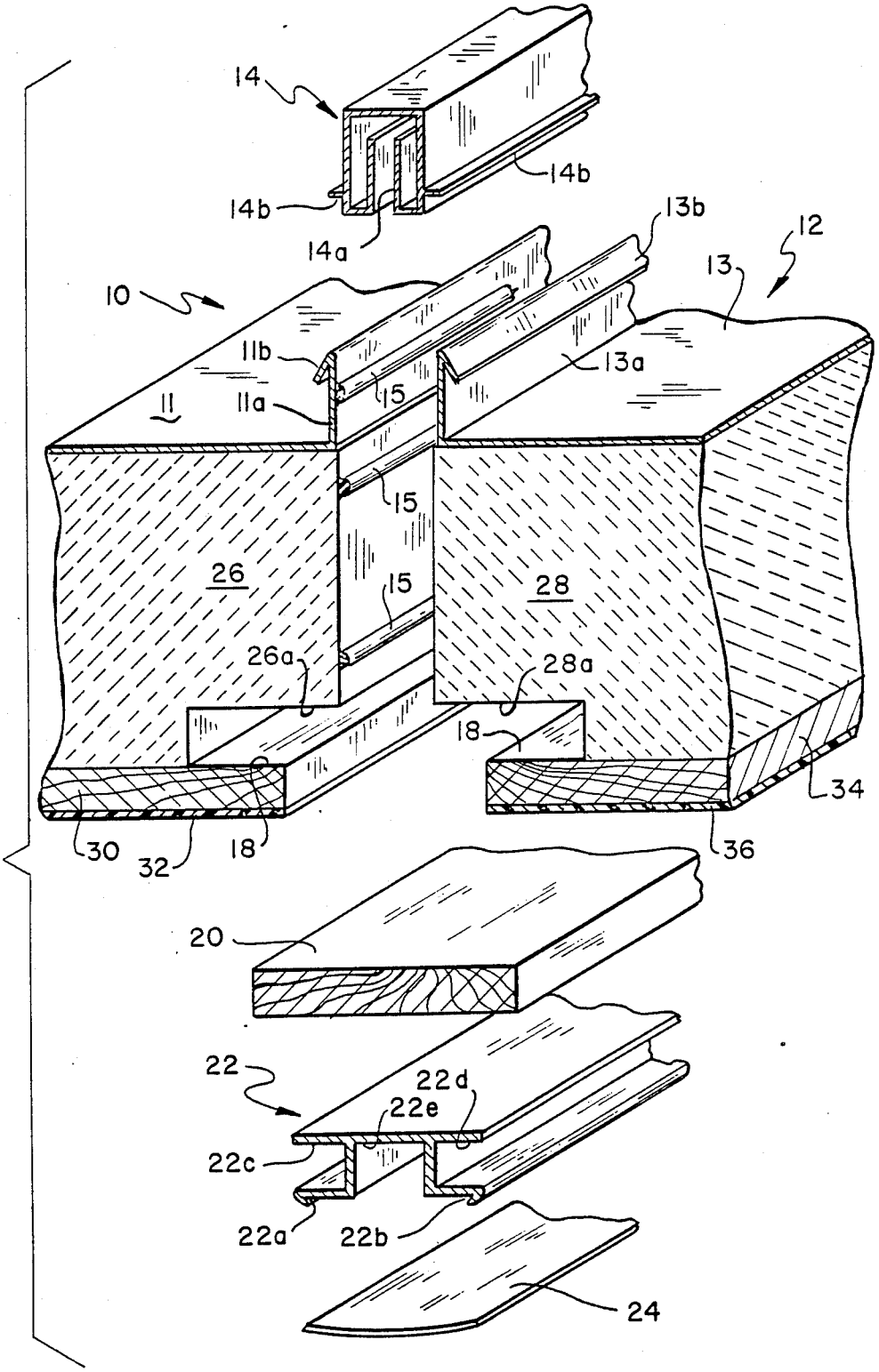
FIG. 1 is an exploded perspective view showing a pair of planar roof panels coupled in accordance with the roof sandwich panel juncture of the present invention.
Figure 2:
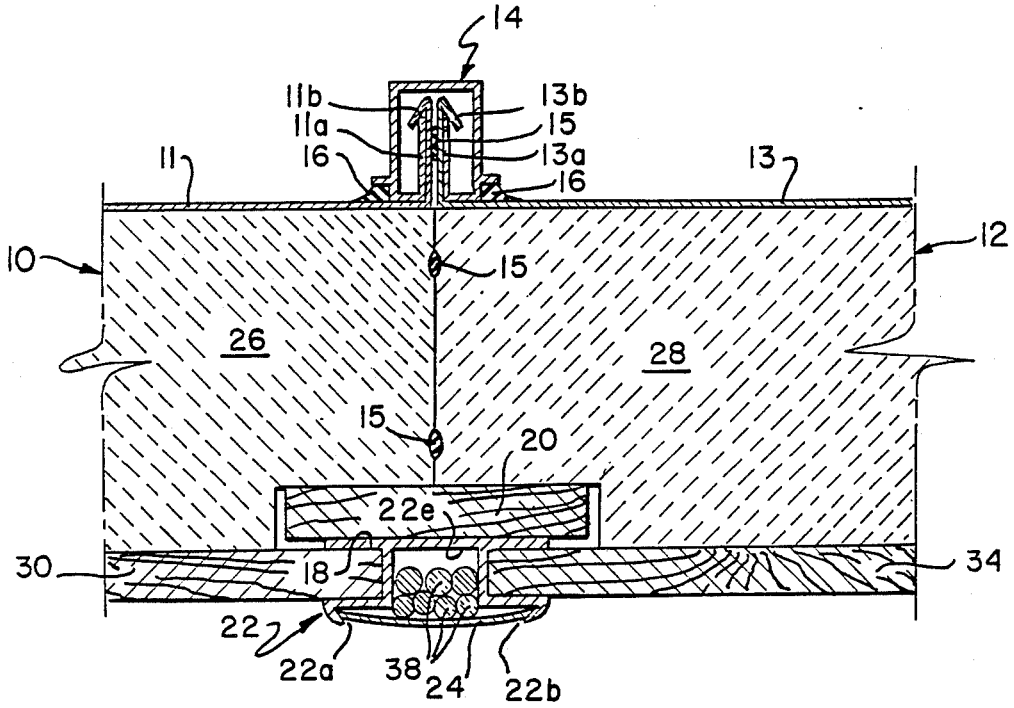
FIG. 2 is a sectional view showing two adjacent roof sandwich panels coupled in accordance with the panel juncture of the present invention.
Figure 3:
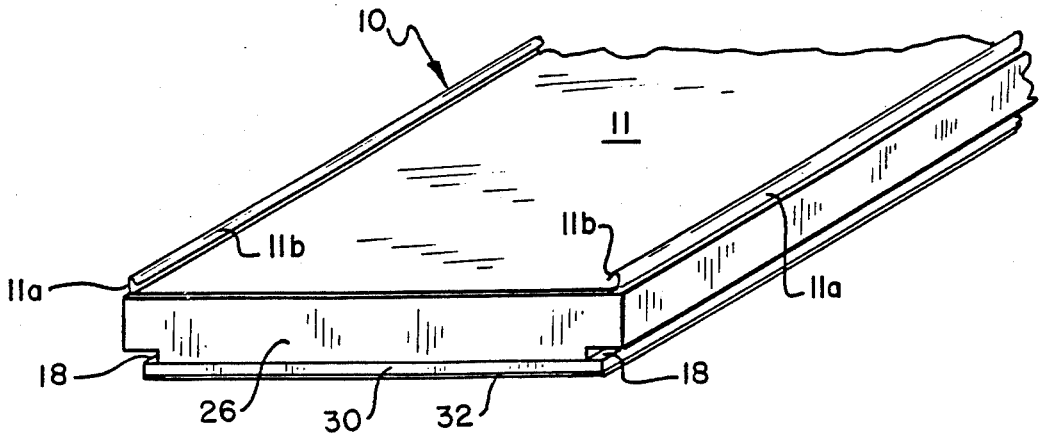
FIG. 3 is a perspective view of a roof sandwich panel for use in the roof panel juncture arrangement of the present invention.

Referring to FIGS. 1 and 2, there are respectively shown exploded perspective and assembled sectional views of first and second roof panels 10, 12 coupled by means of a juncture arrangement in accordance with the present invention. A perspective view of the first roof panel 10 is shown in FIG. 3, it being understood that the second roof panel 12 as well as any other roof panel incorporated in a panel roof system employing a roof panel juncture arrangement in accordance with the present invention would have an identical configuration to that of the roof panel shown in FIG. 3.

Each of the first and second roof panels 10, 12 includes a respective upper facing 11, 13. In a preferred embodiment, each upper facing 11, 13 is comprised of a sheet of aluminum or steel and is turned up at 90° on the edges thereof so as to form respective turned-up edges 11*a*, 13*a* thereon. In addition, the end portions of the turned-up edges 11*a*, 13*a* are turned down toward their associated upper facings so as to form an acute angle with a respective turned-up facing edge coupled thereto. The turned-down end portions of the upper facings 11, 13 of the first and second roof panels 10, 12 are respectively identified as elements 11*b* and 13*b*. Each combination of turned-up edge and turned-down end portions forms a hook as well as a drip-edge as described below. As shown in FIG. 2, when the first and second roof panels 10, 12 are placed in abutting contact along respective edges thereof, the turned-up edges 11*a*, 13*a* are positioned immediately adjacent to one another, with an adhesive mastic strip 15 disposed in tight fitting relation therebetween.

Each of the first and second roof panels 10, 12 further includes a respective lower facing 30, 34 which forms a ceiling member in the panel roof system and is preferably comprised of wood. Disposed between the upper and lower facings 11, 30 of the first roof panel 10 and the upper and lower facings 11, 34 of the second roof panel 12 are respective insulating layers 26, 28, preferably comprised of an expanded foam insulating material such as polystyrene or rigid urethane. The respective upper and lower facings of each of the first and second roof panels 10, 12, are securely bonded in a conventional manner to the insulating foam layers 26, 28 disposed therebetween so as to form a sandwich panel. With the first and second roof panels 10, 12 in abutting contact, it can further be seen that additional mastic strips 15 are preferably positioned between the adjacent, facing edges of the insulated portions of the roof panels in tight fitting relation. Finally, respective edge portions of the insulating foam cores 26, 28 of the first and second roof panels 10, 12 are provided with a notched portion 18, which is partially overlapped by the immediately adjacent lower facing of the panel. Thus, an elongated slot 18 is provided in facing lateral edge portions of each of the first and second roof panels 10, 12 and extends the respective lengths thereof. Each of the turned-up edge and turned-down end portions of the upper facings 11, 13 of the first and second roof panels 10, 12 also extends the length of the panel.

A roof batten 14 preferably comprised of an elongated, linear, metal extrusion such as of aluminum is adapted for sliding engagement with the adjacent, facing edge portions of the upper facings 11, 13 of the first and second roof panels 10, 12. The roof batten 14 includes a generally vertically oriented slot 14*a* therein defined by parallel, spaced members which extend the length of the roof batten. With the respective edge portions of the upper facings 11, 13 of the first and second roof panels 10, 12 in abutting contact, the roof batten 14 is adapted to be displaced along the abutting edge portions of the upper facings in sliding engagement therewith such that its internal members defining the center slot 14*a* therein are positioned beneath and engage corresponding combinations of the turned-up facing edge and turned-down end portions thereof. The respective lower portions of the roof batten 14 are similarly in tight fitting, abutting contact with adjacent, flat portions of the upper facings 11, 13 on the first and second roof panels 10, 12. Respective lateral portions of the roof batten 14 are each provided with a lateral rib 14*b* extending therefrom. Each of the spaces disposed between a respective lateral rib 14*b* of the roof batten 14 and the adjacent upper facing of one of the roof panels is adapted to receive in tight fitting relation a sealing strip 16 along the length thereof.

The adjacent, opposed edges of the lower facings 30, 34 of the first and second roof panels 10, 12 are in spaced relation from one another. A ceiling batten 22, which is also preferably comprised of an elongated, linear, unitary metal extrusion, is provided with a pair of opposed lateral slots 22*c* and 22*d*. Each of the opposed lateral slots 22*c*, 22*d* of the ceiling batten 22 is adapted to securely engage a respective lateral, opposed edge of the lower facings 30, 34 of the first and second roof panels 10, 12. The ceiling batten 22 thus serves to securely couple adjacent edges of the lower facings 30, 34 of the first and second roof panels 10, 12 and to bridge the gap therebetween. The ceiling batten 22 further provides support for and maintains in position a blocking-spline member 20, preferably comprised of wood, positioned lengthwise within the respective, facing slots 18 in the first and second roof panels 10, 12. The blocking-spline member 20 reinforces and strengthens the roof panel juncture of the present invention and serves as a break for the conduction of heat at the roof panel juncture.

The ceiling batten 22 further includes a lower slot 22*e* which is adapted to receive a plurality of electrical conductors 38 disposed along the length thereof. Positioned adjacent to the lower edges of and along the length of the ceiling batten lower slot 22*e* are a pair of spaced retaining notches 22*a*, 22*b*. The retaining notches 22*a*, 22*b* are adapted to receive in tight fitting engagement a snap-in cover 22 comprised of a resilient material which permits the cover to be snapped in position between the two facing retaining notches and to be easily removed therefrom. The ceiling batten 22 in combination with the snap-in cover 24 thus forms an enclosed raceway for supporting and hiding from view electrical conductors 38 positioned therein. The ceiling batten 22 also reinforces and strengthens the roof panel juncture of the present invention while providing an aesthetically pleasing covering for the inter-panel joint.

In assembling the roof panel juncture of the present invention, a plurality of mastic strips 15 are positioned in spaced relation along the length of one of the roof panels on an edge thereof. The first and second roof panels 10, 12 are then positioned in abutting contact with each other along respective, facing edges thereof with the mastic strips 15 disposed in tight fitting relation therebetween. The roof batten 14 is then slid over and along the respective lengths of the turned-up edges 11*a*, 13*a* the upper facings 11, 13 on the first and second roof panels 10, 12. When the roof batten 14 is in place on the turned-up edges of the respective upper facings 11, 13 and extends along the length of the first and second roof panels 10, 12, a pair of sealant strips 16 are positioned at the base of the roof batten 14 between the lateral ribs 14*b* thereof and the respective upper facings 11, 13 of the panels. The blocking-spline member 20 is then slid in the respective edge-mounted slots of the first and second roof panels 10, 12 and is positioned along the lengths thereof. The ceiling batten 22 is then slid into position on the adjacent edges of the lower facings 30, 34 of the roof panels so as to engage the respective, adjacent edges thereof. With the electrical conductors 38 positioned within the bottom slot 22*e* of the ceiling batten 22, the cover 24 is snapped into position on the lower portion of the ceiling batten and extends over the bottom slot 22*e* therein. The roof panel juncture of the present invention is intended to be aligned with the pitch of the panel roof. Thus, the upper roof batten 14 and the lower ceiling batten 22 are aligned with the pitch of the roof. The use of a wood lower facing for the ceiling member in the present invention meets the general requirement of many fire codes in terms of isolating the intermediate foam insulating layer of the panels from the interior of the structure in which the roof panels are used. The blocking-spline member also satisfies most building codes which require a means for breaking or reducing the conduction of heat across a structural joint.

The roof panel juncture arrangement of the present invention provides a water sealed inter-panel coupling in the following five ways:

(1) The sealant strips 16 keep most of the water out of the roof batten extrusion 14;

(2) If water passes the sealant strips 16, it must pass up the standing seam of the roof batten extrusion 14 to the height of the inner leg portion thereof;

(3) If water passes the inner leg portion defining the generally vertical slot within the roof batten 14, the water will run down the roof batten and out of the lower end thereof into a rain gutter (not shown);

(4) The hooked end portions of the turned-up edges of each of the upper facings of the two panels form a drip-edge which directs water to an internal portion of the roof batten and allows it to flow out an open, lower end thereof; and (5) The mastic strips 15 applied to the abutting edges of adjacent roof panels also serve as an effective water seal.

There has thus been shown a roof panel juncture for securely coupling adjacent, abutting roof panels in a sealed manner. Each panel includes a waterproof upper sheet metal facing, a lower wood facing which forms an attractive ceiling, and an intermediate insulating foam core disposed therebetween. The roof panel juncture is waterproof, provides an attractive appearance from below, securely couples adjacent roof panels, and accommodates electrical conductors by providing an enclosed raceway.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A juncture arrangement for coupling first and second generally planar roof panels for use in a pitched roof, each roof panel having a respective upper facing, a lower facing and an intermediate layer of insulation disposed therebetween, said juncture arrangement comprising:

first and second respective upturned edges of the upper facing of the first and second roof panels wherein each of said first and second upturned edges includes a respective proximal generally flat, linear section and a respective distal hooked end bent downwardly at an acute angle toward the plane of its associated upper facing so as to form a pair of spaced drip edges;

a first elongated, linear roof batten adapted for sliding engagement with said abutting upturned edges of the first and second roof panels along the length thereof, said roof batten having a first pair of inner closely spaced, generally flat, parallel members each having a respective distal upper edge portion, wherein the distal upper edge portion of each of said inner members engages a respective upturned edge of an upper facing of the first and second roof panels along a juncture of the proximal and distal sections thereof in maintaining the roof batten in secure engagement with the upturned edges of the upper facings of the first and second roof panels, said roof batten further including a first pair of facing lateral ribs extending outward therefrom;

sealing means disposed between said first roof batten and each respective upper facing of the first and secon roof panels, said sealing means including first and second mastic adhesive strips disposed in tight fitting relation between a respective lateral rib of said first roof batten and a respective upper facing of said first and second roof panels; and a second elongated, linear ceiling batten adapted to engage and couple adjacent, facing edges of the lower facings of the first and second roof panels.

2. A roof panel juncture arrangement in accordance with claim 1 wherein said first roof batten includes a recesses slot along the length thereof for receiving and engaging the upturned edges of the upper facings of the first and second roof panels along the lengths thereof in a sealed manner.

3. A roof panel juncture arrangement in accordance with claim 2 wherein the recessed slot in said roof batten includes parallel spaced edges extending the length of said roof batten and engaging in a sealed manner a respective hooked end of the upturned edges of the upper facings of the first and second roof panels.

4. A roof panel juncture arrangement in accordance with claim 3 wherein said roof batten is comprised of a unitary metal extrusion.

5. A roof panel juncture arrangement in accordance with claim 3 further comprising second sealing means disposed between the abutting upturned edges of the upper facings of the first and second roof panels.

6. A roof panel juncture arrangement in accordance with claim 5 wherein said second sealing means includes at least one compressible mastic adhesive strip aligned along and extending substantially the length of the first and second roof panels.

7. A roof panel juncture arrangement in accordance with claim 6 further comprising third sealing means disposed between abutting edges of the intermediate layers of insulation of each of the first and second roof panels.

8. A roof panel junture arrangement in accordance with claim 7 wherein said third sealing means comprises at least one compressible mastic adhesive strip aligned along and extending substantially the entire length of the first and second roof panels.

9. A roof panel juncture arrangement in accordance with claim 1 wherein said ceiling batten includes first and second opposed recessed slots therein for receiving and engaging a respective adjacent edge of the lower facings of each of the first and second roof panels.

10. A roof panel juncture arrangement in accordance with claim 9 wherein said ceiling batten further includes a third recessed slot in a lower portion thereof and an elongated cover positioned over and along the length of said third recessed slot so as to form an enclosed raceway.

11. A roof panel juncture arrangement in accordance with claim 10 wherein the lower portion of said ceiling batten further includes a pair of spaced retaining means and wherein said elongated cover is resilient to permit snap-acting engagement of said cover with said pair of spaced retaining means for secure positioning of said cover on the lower portion of said ceiling batten.

12. A roof panel juncture arrangement in accordance with claim 11 wherein said ceiling batten is comprised of a unitary metal extrusion.

13. A roof panel juncture arrangement in accordance with claim 1 wherein the facing edges of the respective layers of insulation of the first and second roof panels include a respective slot therein and wherein said roof panel juncture further includes a blocking spline member positioned within each of said insulation layer slots so as to overlap each of said first and second roof panels and strengthen the juncture therebetween.

14. A roof panel juncture arrangement in accordance with claim 13 wherein said blocking spline member is positioned in contact with and supported by said ceiling batten.

15. A roof panel juncture arrangement in accordance with claim 14 wherein said blocking spline member is comprised of wood.

16. A roof panel juncture arrangement in accordance with claim 1 wherein the upper facing of each of the first and second roof panels is comprised of a thin metallic sheet.

17. A roof panel juncture arrangement in accordance with claim 1 wherein the lower facing of each of the first and second roof panels is comprised of wood and includes a lower vinyl covering thereon.

18. A roof panel juncture arrangement in accordance with claim 1 wherein the intermediate layer of insulation of each of the first and second roof panels is comprised of a rigid foam material.

19. A roof panel juncture arrangement in accordance with claim 1 wherein said juncture arrangement is aligned with the pitch of the roof.

20. A juncture arrangement for coupling first and second generally planar roof panels for use in a pitched roof, wherein each of said panels includes a respective upper facing, a lower facing, and an intermediate layer of insulation disposed therebetween, said roof panel juncture arrangement comprising:

first and second respective upturned edges of the upper facings of the first and second roof panels each having a respective proximal generally flat, linear section and a distal hooked end bent downwardly at an acute angle toward the plane of its associated upper facing so as to form a pair of spaced drip edges, wherein said first and second upturned edges are aligned with the pitch of the roof;

an elongated linear roof batten adapted for sliding engagement with the abutting upturned edges of the upper facings of each of the first and second roof panels along the length thereof, said roof batten having a first pair of inner closely spaced, generally flat, parallel members each having a respective distal upper edge portion, wherein the distal upper edge portion of each of said inner members engages a respective upturned edge of an upper facing of the first and second roof panels along a juncture of the proximal and distal sections thereof in maintaining the roof batten in secure engagement with the upturned edges of the upper facings of the first and second roof panels, said roof batten further including a first pair of facing lateral ribs extending outward therefrom; and sealing means disposed between said first roof batten and each respective upper facings of the first and second roof panels, said sealing means including first and second mastic adhesive strips disposed in tight fitting relation between a respective lateral rib of said first roof batten and a respective upper facing of said first and second roof panels.

21. A roof panel juncture arrangement in accordance with claim 20 wherein said first roof batten includes a recessed slot along the length thereof for receiving and engaging the upturned edges of the upper facings of the first and second roof panels along the lengths thereof in a sealed manner.

22. A roof panel juncture arrangement in accordance with claim 21 wherein the recessed slot in said roof batten is defined by said first pair of inner, closely spaced, generally flat, parallel members and extends the length of said roof batten and engages in a sealed manner a respective hooked end of the upturned edges of the upper facings of the first and second roof panels.

23. A roof panel juncture arrangement in accordance with claim 22 wherein said roof batten is comprised of a unitary metal extrusion.

24. A roof panel juncture arrangement in accordance with claim 22 further comprising second sealing means disposed between the abutting upturned edges of the upper facings of the first and second roof panels.

25. A roof panel juncture arrangement in accordance with claim 24 wherein said second sealing means includes at least one compressible mastic adhesive strip aligned along and extending substantially the length of the first and second roof panels.

26. A roof panel juncture arrangement in accordance with claim 25 further comprising third sealing means disposed between abutting edges of the intermediate layers of insulation of each of the first and second roof panels.

27. A roof panel juncture arrangement in accordance with claim 26 wherein said third sealing means comprises at least one compressible mastic adhesive strip aligned along and extending substanially the entire length of the first and second roof panels.

28. A roof panel juncture arrangement in accordance with claim 20 wherein said juncture arrangement is aligned with the pitch of the roof.

29. A juncture arrangement for coupling first and second generally planar roof panels for use in a pitched roof, each of said roof panels having a respective facing edge portion having a slot therein, wherein each of said panels includes a respective upper facing, a lower facing, and an intermediate layer of insulation disposed therebetween, said roof panel juncture arrangement comprising:

a blocking spline member positioned within each of the slots in the respective facing edge portions of the roof panels so as to overlap each of said first and second roof panels and strengthen the juncture therebetween;

a ceiling batten including first and second lateral, opposed, recessed slots extending the length thereof and adapted to receive and engage a respective edge of the lower facing of each of the first and second roof panels for coupling said panels, wherein said ceiling batten engages and provides support for said blocking spline along the length thereof, said ceiling batten further including a third recessed slot in a lower portion and extending the length thereof;

an elongated cover positioned over the third recessed slot of said ceiling batten and extending the length thereof so as to form an enclosed raceway in said ceiling batten; and engaging means positioned on a lower portion of said ceiling batten adjacent to the third recessed slot therein for engaging and maintaining said elongated cover securely in position on said ceiling batten.

30. A roof panel junture arrangement in accordance with claim 29 wherein said ceiling batten is comprised of a unitary metal extrusion.

31. A roof panel juncture arrangement in accordance with claim 29 wherein said blocking spline member is comprised of wood.

32. A roof panel juncture arrangement in accordance with claim 29 wherein the lower facing of each of the first and second panels is comprised of wood and includes a lower vinyl covering thereon.

33. A roof panel juncture arrangement in accordance with claim 29 wherein said juncture arrangement is aligned with the pitch of the roof.

* * * * *

UNITED STATES PATENT AND TRADEMARK OFFICE

CERTIFICATE OF CORRECTION

PATENT NO. : 4,671,038

DATED : June 9, 1987

INVENTOR(S) : William H. Porter

It is certified that error appears in the above-identified patent and that said Letters Patent is hereby corrected as shown below:

Column 6, line 59, "recesses" should be -- recessed --.

Column 8, line 38, "facings" should be -- facing --.

Signed and Sealed this

Eighth Day of September, 1987

*Attest:*

DONALD J. QUIGG

*Attesting Officer*

*Commissioner of Patents and Trademarks*